US010538957B2

(12) United States Patent
Brown

(10) Patent No.: US 10,538,957 B2
(45) Date of Patent: Jan. 21, 2020

(54) ACOUSTIC WINDOW SYSTEM FOR USE WITH ACOUSTIC DOOR

(71) Applicant: Randy Brown, Reno, NV (US)

(72) Inventor: Randy Brown, Reno, NV (US)

(73) Assignee: JAR Properties, LLC, Reno, NV (US)

( * ) Notice: Subject to any disclaimer, the term of this patent is extended or adjusted under 35 U.S.C. 154(b) by 357 days.

(21) Appl. No.: 15/660,561

(22) Filed: Jul. 26, 2017

(65) Prior Publication Data

US 2019/0032396 A1 Jan. 31, 2019

(51) Int. Cl.
*E06B 5/20* (2006.01)
*E06B 3/54* (2006.01)

(52) U.S. Cl.
CPC ..... *E06B 5/205* (2013.01); *E06B 3/5454* (2013.01)

(58) Field of Classification Search
CPC ..... E06B 5/205; E06B 3/5454
USPC ..... 181/211
See application file for complete search history.

(56) References Cited

U.S. PATENT DOCUMENTS 6,520,288 B1 * 2/2003 Quam ..... E05D 7/009 181/287

* cited by examiner

*Primary Examiner* — Jeremy A Luks
(74) *Attorney, Agent, or Firm* — Mark A. Goodman, Esq.

(57) ABSTRACT

A sound proofing window system for use with an acoustic door is disclosed. The system includes 2 fully decoupled acoustic reveal formed between 2 acoustic windows, thereby providing a higher level of sound proofing than is achievable with existing art. A decoupled acoustic reveal means that there is no path of contact between the two acoustic windows that is unbroken by soundproofing material. Further, the acoustic windows may be positioned fully or partially outside the thickness of the door to increase the air gap. Prior art systems may attempt to partially decouple the acoustic reveal. A windowed standard 1.75 inch acoustic door according to the present invention provides an STC rating of 56-57, which is far superior to the 35-47 STC rating comparable prior art. The STC rating of the present invention on a 5 inch thick door is estimated at 64 compared to 54 using conventional technology.

12 Claims, 3 Drawing Sheets

ACOUSTIC WINDOW SYSTEM FOR USE WITH ACOUSTIC DOOR

BACKGROUND OF THE DISCLOSURE

Technical Field of the Disclosure

The present disclosure relates generally to sound proofing systems, and more particularly to a soundproof window system for use with an acoustic door featuring a fully decoupled acoustic reveal.

Background of the Invention

A wide variety of acoustic doors and windows have been developed to block intrusive sound vibrations. These sound resistant doors and windows are commonly utilized in legal facilities, recording studios, theaters, educational institutions, commercial and residential buildings and hotels. The sound resistant doors and windows block noise from entering into the doors and windows thereby protecting from the impacts of noise pollution. These soundproof windows are rated on a sound transmission class (STC) scale. If a window exhibits a higher value in the STC scale then that window inhibits more sound vibrations.

Sound resistant windows have multiple layers of thick glasses having air gaps in between to reduce noise vibrations. The multiple layers of glasses include a dampening core layer that prevents vibration of sound from one pane of glass to the other. The sound resistant glass can be customized for multi-functional glazing, such as thermal insulation and sun protection. Replacement windows and double pane windows are also utilized for suppressing noise vibrations.

Various sound resistant windows and doors have been developed to limit noise transmission through buildings. One such sound resistant system describes a soundproof assembly having front and rear panels with one or both of the front and rear panels having a laminar structure. This soundproof assembly has low STC rate therefore the system can only inhibit a limited range of sound frequencies.

Another sound resistant system describes a sound proof swinging door that carries at its bottom end a pair of parallel spaced rollers which extend substantially the full width of the door and which, when the door is closed, are spring energized into rolling engagement with the bottom transverse member of a door frame or sill for soundproofing the bottom of the door. This sound proof door is made of heavy materials which causes difficulty in transporting the bulky door from one place to another.

Yet another sound resistant glass system includes an insulated glazed unit for use in a window or door of a building for reducing the transmission of sound energy there through. The insulated glazed unit comprises a plurality of glass panels each with a front face and a rear face and each of a distinct thickness. This insulated glazed unit includes less air space between the glass panels. Further, these glass panels are less efficient in suppressing sound vibrations leading to the transfer of more sound waves through the window or door.

Thus, there is a need for a superior soundproofing, sound blocking and vibration damping system. Such as system would be easy to mount on the surface of an existing door and window. Further, such a sound resistant system would be installed without replacing or removing the existing door. Moreover, such a needed system would exhibit a high STC rating thereby achieving a significant level of vibration isolation through the door. Such a needed sound resistant system would possess more air space between the glass panels in the system.

Further, such a needed sound resistant system would include an acoustic absorptive foam material between a glass assembly and a door which would isolate the glass assembly from transferring sound vibrations through the door. Moreover, such a sound resistant system would include an open air space between the glass assemblies of the system thereby enabling the air space to absorb maximum sound vibrations. As well, the system should further increase the air gap by being configured to hold acoustic windows outside of the thickness of the acoustic door. These and other objectives are accomplished by the present invention.

SUMMARY OF THE INVENTION

To minimize the limitations found in the prior art, and to minimize other limitations that will be apparent upon the reading of the specification, the preferred embodiment of the present invention provides an acoustic window system for use with an acoustic door. The acoustic window system comprises an acoustic door having a first face, a second face, and an interior edge. The acoustic window system further includes a first window mounting bracket supporting a first acoustic window, and a second window mounting bracket holding a second acoustic window. The first and the second window mounting brackets are infused with a sound blocking material. The sound blocking material comprises an acoustic absorptive foam.

A first rivet nut is disposed on the first face of the acoustic door element and a second rivet nut is disposed on the second face of the acoustic door. A first attaching screw attaches the first window mounting bracket with the first face via the first rivet nut and the second attaching screw attaches the second window mounting bracket to the second face via the second rivet nut. A sound blocking material is disposed between the window mounting brackets and the acoustic door. The first and second sheets of sound blocking material are made of neoprene rubber. The acoustic window system includes a first and second sheet of vibration damping material. The vibration damping material comprises medium-density neoprene foam. The acoustic windows form an air gap and the air gap is unsealed.

The acoustic window system further includes a first L-shaped pop rivet bracket and a second L-shaped pop rivet bracket. The first L-shaped pop rivet bracket is affixed about the first face and the interior edge of the acoustic door and the second L-shaped pop rivet bracket is affixed about the second face and the interior edge of the acoustic door. The first and the second pop rivet brackets do not have contact with each other. The acoustic window system further includes a first pop rivet and a second pop rivet. The first pop rivet attaches to the first pop rivet bracket through the first sheet of vibration damping material and the second pop rivet attaches to the second pop rivet bracket through the first sheet of vibration damping material. The first acoustic window and the second acoustic window form a decoupled acoustic reveal. The acoustic window system includes a sheet of non-metallic sound absorptive material attached to the interior edge of the acoustic door element. The sheet of non-metallic sound absorptive material is made of acoustic absorptive foam. The opening for the window in the door is not connected front to back; rather it has a "broken" connection so that the vibrations cannot directly transfer through the door. In another configuration of the preferred embodiment, the acoustic window system comprises an acoustic door having a first face, a second face, and an interior edge. The acoustic window system further comprises a first window assembly and a second window assembly. The first window assembly is coupled with a first acoustic window and is mounted on the first face of the acoustic door. The second window assembly is coupled with a second acoustic window and is mounted on the second face of the acoustic door. The acoustic windows form an air gap and the air gap may be unsealed to decrease transmission of sound waves across the gap.

A first objective of the present invention is an acoustic window system for suppressing maximum sound vibrations through a window of an acoustic door by creating a fully decoupled acoustic reveal.

A second objective of the present invention is to provide an acoustic window system exhibiting high sound transmission class (STC) rate thereby achieving a significant level of sound vibration isolation through doors and windows.

A third objective of the present invention is to provide an acoustic window system featuring an acoustic absorptive foam or other material between an acoustic window and a door which would isolate the acoustic window from transferring sound vibrations to the door.

A further objective of the present invention is to provide an acoustic window system having an open air space between acoustic windows of the system thereby enabling the air space to absorb maximum sound vibrations.

A still further objective of the present invention is to provide an acoustic window system that is easy to mount on the surface of an existing door and window.

A still further objective of the preset invention is to provide a larger air gap between the acoustic windows by mounting acoustic windows totally or partially outside the thickness of the acoustic door. Put another way, the acoustic windows according to the present invention may be totally or partially position outside of the area defined by a plane extending from each face of the acoustic door about the interior edge of the acoustic door. This dramatically increases the airgap between the acoustic windows. On a prior art 1.75 inch thick acoustic door the airgap is 1-0.25 inches. Utilizing this embodiment of the present invention, the airgap is a full inches. On a 3 inch thick prior art acoustic door, the air gap is 2-2.25 inches. Utilizing this embodiment of the present invention, the airgap is a full 2 inches.

These and other advantages and features of the present invention are described with specificity so as to make the present invention understandable to one of ordinary skill in the art.

BRIEF DESCRIPTION OF THE FIGURES

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention, thus the drawings are generalized in form in the interest of clarity and conciseness.

DETAILED DESCRIPTION OF THE INVENTION

Figure 1:
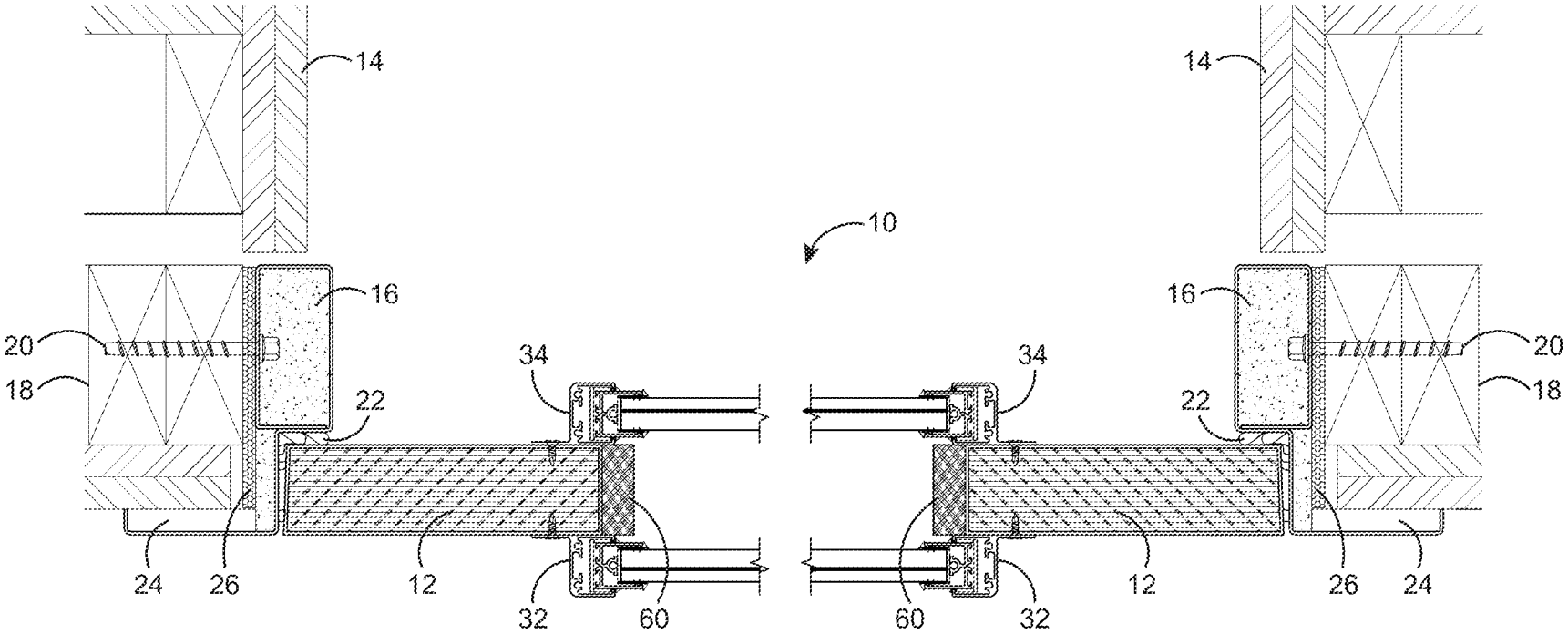
FIG. 1 shows a cross-sectional view of an acoustic window system, illustrating an acoustic door according to the preferred embodiment of the present invention.

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that can each be used independently of one another or in combination with other features. However, any single inventive feature may not address any of the problems discussed above or only address one of the problems discussed above. Further, one or more of the problems discussed above may not be fully addressed by any of the features described below.

As used herein, the singular forms "a", "an" and "the" include plural referents unless the context clearly dictates otherwise. "And" as used herein is interchangeably used with "or" unless expressly stated otherwise. As used herein, the term 'about" means +/−5% of the recited parameter. All embodiments of any aspect of the invention can be used in combination, unless the context clearly dictates otherwise.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to". Words using the singular or plural number also include the plural and singular number, respectively. Additionally, the words "herein," "wherein", "whereas", "above," and "below" and words of similar import, when used in this application, shall refer to this application as a whole and not to any particular portions of the application.

The description of embodiments of the disclosure is not intended to be exhaustive or to limit the disclosure to the precise form disclosed. While the specific embodiments of, and examples for, the disclosure are described herein for illustrative purposes, various equivalent modifications are possible within the scope of the disclosure, as those skilled in the relevant art will recognize.

The following definitions shall apply to all parts of this application.

Acoustic Door: A heavy door which is gasketed along the top and sides; usually has an automatic door bottom; especially constructed to reduce noise transmission through it; usually carries a high sound transmission class (STC) rating, which is a measure of its sound blocking value. The door may be hollow or solid. Generally, a metal acoustic door will be hollow while a wooden acoustic door will be solid.

Acoustic Window: A solid heavy window especially constructed to reduce noise transmission through it, usually carrying an STC value.

Soundproofing material: Soundproofing materials keep sound contained in a space, make it harder for sound to move to other parts of a building, and stop unwanted sound from entering a room. Soundproofing materials include materials that block sound by reflection and/or diffusing sound as well as materials that absorb sound.

Sound absorptive material: Sound absorptive materials absorb into themselves the extra sound waves that bounce around a space and cause poor acoustics, background noise, and bad echo. Sound absorptive materials drastically improve speech intelligibility and the sound quality of rooms, cars, boats, and other enclosed spaces. They improve the quality of the sound within a room. Examples of when sound absorptive materials are used include reducing the noise of clattering dishes in the dining area of a restaurant; providing a lecture hall with minimal reverberation so that the speaker can be heard clearly from any seat; providing a recording studio with minimal sound reflections to preserve the clarity of the sound being produced and recorded.

Vibration damping material: Vibration damping materials prevent the transmission of vibrations from one material that is in contact with the vibration damping material to another material that is also in contact with the vibration damping material.

Sound blocking material: Sound blocking materials stop, reflect, or reroute noise to prevent its transmission through a surface. They are hard, heavy, and flexible. If the sound you need to control is not originating from the same space as the space that quiet is desired sound blocking materials may be the best solution. Examples of where sound blocking materials are used include: blocking traffic noise from entering a house; avoiding hearing the music from the neighbor's apartment; creating a quiet room in a home where one can concentrate.

Decoupling: The basic definition of decouple is to separate objects. Resilient clips, resilient channel, double stud and staggered stud framing are the different ways to decouple a wall or ceiling. Sound transfers through vibrations and if two materials are not touching or have minimal contact, then sound transmission will be seriously reduced. Decoupling is a major advantage of the present invention, as Applicant asserts that the two acoustic windows are more fully decoupled than any prior art.

Figure 2:
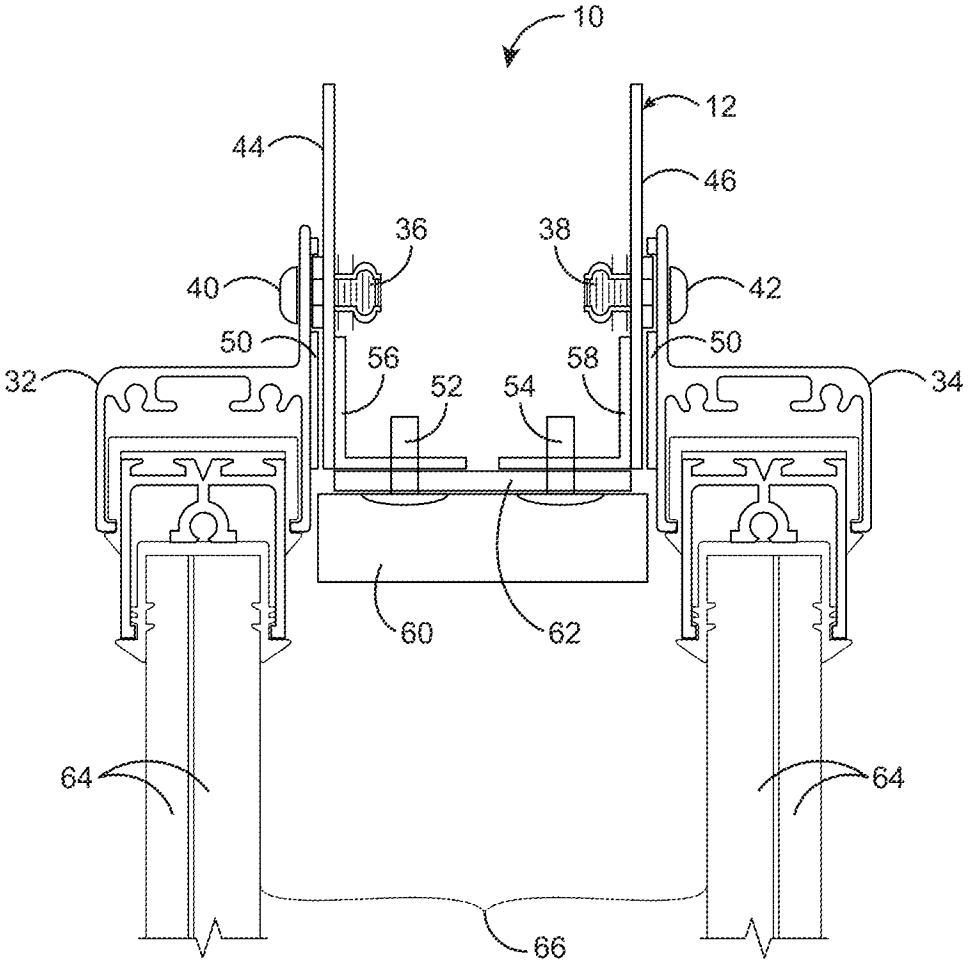
FIG. 2 shows a cross-sectional view of the acoustic window system according to the preferred embodiment of the present invention.
Figure 3:
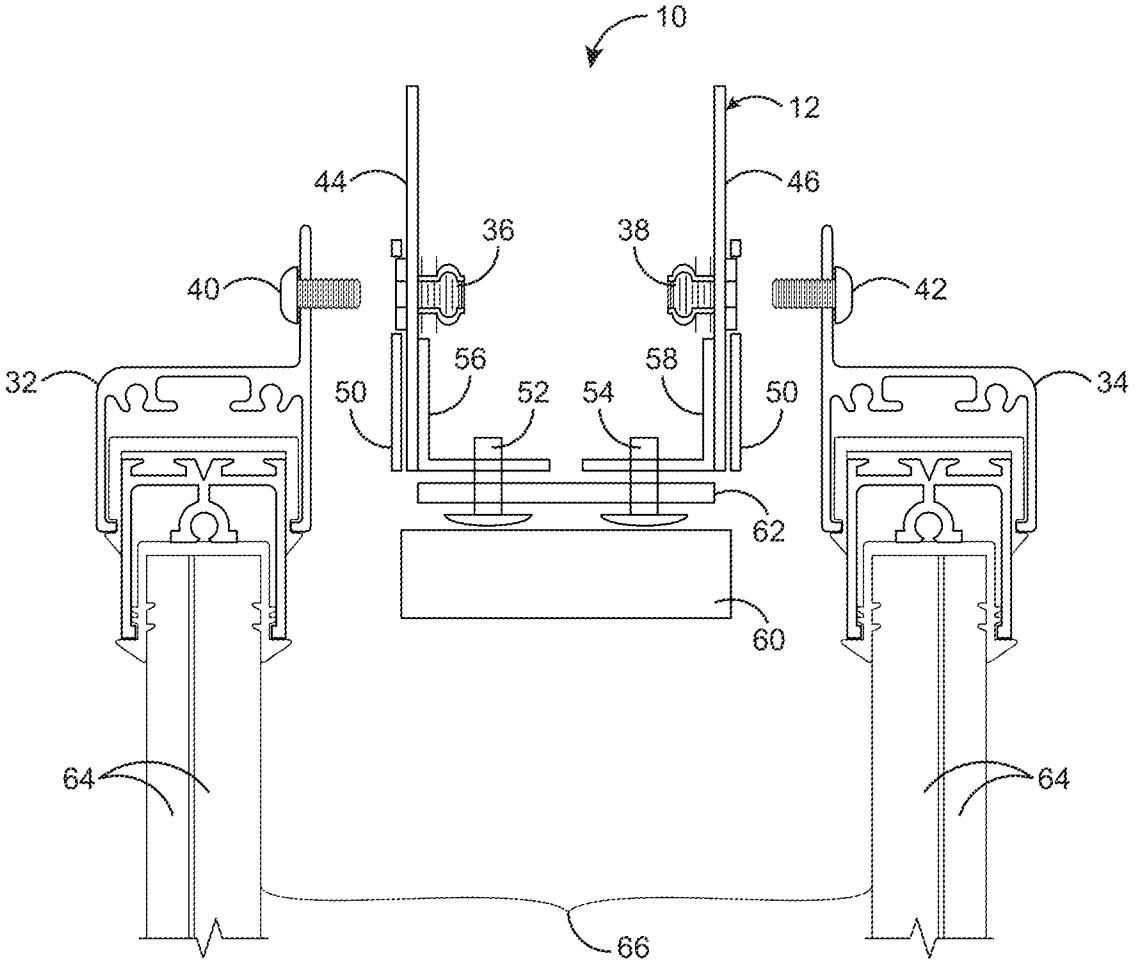
FIG. 3 shows an exploded cross-sectional view of the acoustic window system according to the preferred embodiment of the present invention.

A decoupled acoustic reveal: A central objective of the present invention is the formation of a fully decoupled reveal between the two acoustic windows. A decoupled acoustic reveal means that there is no path of contact between the two acoustic windows that is unbroken by soundproofing material. Prior art systems attempt to partially decouple the acoustic reveal; however, Applicant is aware of no prior art that fully decouples the acoustic reveal. This concept is illustrated at FIG. 2. There is no way to draw a line from one of the acoustic windows 64 to the other acoustic window 64 without either running into either: (1) Sound blocking material 50; (2) the sound absorptive material 60; (3) the acoustic door 12; (4) the sheet of vibration damping material 62; (5) or the air gap 66;

Referring to FIGS. 1-3 of the drawings, an acoustic window system for use with an acoustic door for suppressing maximum sound vibrations according to the present invention is generally designated by the reference numeral 10. As shown in FIGS. 2 and 3, the acoustic window system 10 comprises an acoustic door 12 having a first face 44, a second face 46, and an interior edge. The acoustic door 12 is disposed within a double layer acoustic wall element 14 having a jamb layer and a non-jamb layer. The acoustic window system 10 further comprises a grouted door frame 16 disposed about the acoustic door element 12 and affixed to the wall element 14. A mounting bracket 18 is affixed on a jamb side of the acoustic door element 12 via a mounting screw 20. Sound-resistant gaskets and sound-resistant seals 22 are disposed between the mounting bracket 18 and the acoustic door element 12. A sound absorptive foam 60 is affixed between the grouted door frame 16 and the jamb layer of the wall element 14. The sound-resistant foam 24 comprises neoprene acoustic foam. A plurality of shims and acoustic caulk 26 are disposed between the grouted door frame 16 and the jamb side of the wall element 14. The mounting screw 20 passes through the shims and acoustic caulk 26.

The acoustic window system 10 further includes a first window mounting bracket 32 supporting a first acoustic window, and a second window mounting bracket 34 holding a second acoustic window. The first and the second window mounting brackets 32, 34 are infused with a sound blocking material 50. In the preferred embodiment, the sound blocking material 50 comprises an acoustic absorptive foam. In another configuration of the preferred embodiment, the sound blocking material comprises medium-density neoprene foam.

A first rivet nut 36 is disposed on the first face 44 of the acoustic door 12 and a second rivet nut 38 is disposed on the second face 46 of the acoustic door 12. A first attaching screw 40 attaches the first window mounting bracket 32 with the first face 44 via the first rivet nut 36 and a second attaching screw 42 attaches the second window mounting bracket 34 to the second face 46 via the second rivet nut 38. The sound blocking material 50 is disposed between the window mounting brackets 32, 34 and the acoustic door 12. The first and second sheets of sound blocking material 50 are made of neoprene rubber. The acoustic window system 10 includes a first and second sheet of vibration damping material. The vibration damping material comprises medium-density neoprene foam. The acoustic windows form an air gap and the air gap is unsealed. The acoustic window system 10 further includes a first L-shaped pop rivet bracket 56 and a second L-shaped pop rivet bracket 58. As shown in FIG. 2, the first L-shaped pop rivet bracket 56 is affixed about the first face 44 and the interior edge of the acoustic door 12 and the second L-shaped pop rivet bracket 58 is affixed about the second face 46 and the interior edge of the acoustic door 12. The first and the second pop rivet brackets 56, 58 do not contact with each other. The acoustic window system 10 further includes a first pop rivet 52 and a second pop rivet 54. The first pop rivet 52 attaches to the first pop rivet bracket 56 through a first sheet of vibration damping material 62 and the second pop rivet 54 attaches to the second pop rivet bracket 58 through the first sheet vibration damping material 62. The first sheet of vibration damping material 62 may be made of neoprene rubber.

In another configuration of the preferred embodiment, the window acoustic system 10 includes a second sheet of sound resistant material attached to the interior edge of the acoustic door 12. Preferably, the second sheet of sound-resistant material is made of acoustic absorptive foam. The acoustic window assemblies 64 form an air gap 66 which is unsealed.

A door glass may be mounted on the surface of the door 12 thereby allowing more air space between the two panes of glass. This feature of the system 10 can be applied to any acoustic door made of wood, steel or any other material. The acoustic window 64 (before attachment) utilized in the window acoustic system 10 is unique. The door glass is wrapped with a marine glaze vinyl boot and is inserted into an aluminum profile to create a first assembly. This first assembly is then wrapped in a similar vinyl glazing boot and inserted into the glass frame assembly to create a second assembly. The marine boot isolates the glass from the aluminum thereby suppressing sound vibration transfer. The second glazing utilized for creating the second assembly allows vibration isolation, enables more overall assembly movement and vibration and also assists in litigating the heavier mass of the thick laminated glass and stops even more noise transfer. In this method, the glass is first isolated then the overall assembly is isolated to achieve a double vibration suppression technique.

The acoustic window 64 is designed to attach with the steel door skin. The acoustic window 64 includes neoprene foam between it and the door 12. This is an added advantage of the acoustic window system 10 that further isolates the acoustic window 64 from transferring vibrations to the door 12. As shown in FIGS. 1-3, the opening for the window 64 in the door 12 is not connected front to back; rather it has a "broken" connection so that the vibrations cannot directly transfer through the door 12. In order to connect the two sides, the stiff ⅛" layer of neoprene 50 is laid down and this neoprene 50 is attached to each side of the glass opening through the door 12 utilizing the first and the second pop rivets 52, 54. Therefore, the two sides are connected via the neoprene rubber 50 which does not transfer noise. This prevents door thickness expansion while maintaining the vibration isolation through the door 12. On top of the neoprene 50 a ½" layer of medium density acoustic absorptive foam 60 is attached. This foam 60 helps to absorb noises that are present between the two layers of glass. In this way, as the noise passes through the two pieces of glass some of the noise gets absorbed.

In another configuration of the preferred embodiment, the acoustic window system 10 comprises an acoustic door 12 having a first face 44, a second face 46, and an interior edge. The acoustic window system 10 further comprises a first window assembly and a second window assembly. The first window assembly is coupled with a first acoustic window and is mounted on the first face of the acoustic door 12. The second window assembly is coupled with a second acoustic window and is mounted on the second face of the acoustic door 12. The first and the second acoustic windows form a decoupled acoustic reveal. The acoustic windows 64 form an air gap and the air gap may be unsealed to decrease transmission of sound waves across the gap.

The opening between the two acoustic windows 64 creates the sizable air gap 66. For a standard 1.75" door, the air gap is almost two inches. Since this air gap 66 is "open" (rather than sealed tight) to the guts of the door through the gaps, the air space can "breath" and can absorb/stop noise better than it could be in an environment where the air space is sealed—like in a dual pane acoustic window 64. This air gap 66 can add several decibels to the ability of the door 12 to stop noise (measured in decibels). In one configuration of the preferred embodiment, the sound transmission class (STC) rating of the acoustic window system 10 ranges from STC 48 to almost STC 57 which is a high value for achieving a significant level of sound vibration isolation through doors and windows.

The acoustic window system 10 is designed to mount on the surface of an existing door and window. Further, the acoustic window system 10 can be installed without replacing or removing the existing and door.

The foregoing description of the preferred embodiment of the present invention has been presented for the purpose of illustration and description. It is not intended to be exhaustive or to limit the invention to the precise form disclosed. Many modifications and variations are possible in light of the above teachings. It is intended that the scope of the present invention not be limited by this detailed description, but by the claims and the equivalents to the claims appended hereto.

What is claimed is:

1. An acoustic window system for use with an acoustic door comprising:

a. an acoustic door, the acoustic door elements having a first face, a second face, and an interior edge;

b. a first window mounting bracket holding a first acoustic window, and a second window mounting bracket holding a second acoustic window;

c. a first attaching screw and a second attaching screw;

d. a first rivet nut disposed on the first face of the acoustic door element and a second rivet nut disposed on the second face of the acoustic door element;

e. wherein the first attaching screw attaches the first window mounting bracket to the first face via the first rivet nut and the second attaching screw attaches the second window mounting bracket to the second face via the second rivet nut;

f. sound blocking material is disposed between the window mounting brackets and the acoustic door;

g. a first pop rivet and a second pop rivet;

h. a first L-shaped pop rivet bracket and a second L-shaped pop rivet bracket;

i. a first and second sheet of vibration damping material;

j. the first pop rivet bracket is affixed about the first face and the interior edge of the acoustic door and the second pop rivet bracket is affixed about the second face and the interior edge of the acoustic door, and the first and second pop rivet brackets do not contact each other;

k. the first pop rivet attaches to the first pop rivet bracket through the first sheet of vibration damping material and the second pop rivet attaches to the second pop rivet bracket though the second sheet of vibration damping material, l. wherein the first acoustic window and the second acoustic window thereby form a decoupled acoustic reveal.

2. The system of claim 1, further including a sheet of non-metallic sound absorptive material attached to the interior edge of the structural element.

3. The system of claim 2, wherein the sheet of non-metallic sound absorptive material is made of acoustic absorptive foam.

4. The system of claim 1, wherein the first and second sheets of sound blocking material are made of neoprene rubber.

5. The system of claim 1, wherein the first and second window mounting brackets are infused with a vibration damping material.

6. The system of claim 5 wherein the sound absorptive material comprises acoustic absorptive foam.

7. The system of claim 1 wherein the vibration damping material comprises medium-density neoprene foam.

8. The system of claim 1 wherein the acoustic windows form an air gap and the air gap is unsealed.

9. The system of claim 1 wherein the first window mounting bracket is configured to hold the first acoustic window such that a portion of the first acoustic window lies outside of an area about the interior edge of the acoustic door defined by a plane extending the first face of the acoustic door, and a plane extending the second face of the acoustic door, thereby providing greater airspace between the first acoustic window and the second acoustic window.

10. The system of claim 9 wherein the second window mounting bracket is configured to hold the acoustic window such that the second acoustic window lies completely outside of an area about the interior edge of the acoustic door defined by a plane extending the first face of the acoustic door, and a plane extending the second face of the acoustic door, thereby providing greater airspace between the first acoustic window and the second acoustic window.

11. The system of claim 1 wherein the first window mounting bracket is configured to hold the acoustic window such that the first acoustic window lies completely outside of an area about the interior edge of the acoustic door defined by a plane extending the first face of the acoustic door and a plane extending the second face of the acoustic door, thereby providing greater airspace between the first acoustic window and the second acoustic window.

12. The system of claim 11 wherein the second window mounting bracket is configured to hold the acoustic window such that the second acoustic window lies completely outside of an area about the interior edge of the acoustic door defined by a plane extending the first face of the acoustic door and a plane extending the second face of the acoustic door, thereby providing greater airspace between the first acoustic window and the second acoustic window.

* * * * *